United States Patent [19]

Fluck et al.

[11] Patent Number: 4,805,845

[45] Date of Patent: Feb. 21, 1989

[54] METHOD AND APPARATUS FOR WINDING A THREAD AND A PACKAGE FORMED THEREBY

[75] Inventors: Jakob Fluck; Felix Graf, both of Winterthur, Switzerland

[73] Assignee: Rieter Machine Works, Ltd., Winterthur, Switzerland

[21] Appl. No.: 86,952

[22] Filed: Aug. 19, 1987

[30] Foreign Application Priority Data

Aug. 22, 1986 [CH] Switzerland ..... 03390/86

[51] Int. Cl.[4] ..... B65H 54/00; B65H 55/00; B65H 55/04

[52] U.S. Cl. ..... 242/18 EW; 242/164; 242/165; 57/202; 57/908; 28/276

[58] Field of Search ..... 242/18 EW, 18 A, 18 DD, 242/18 R, 18 PW, 164, 165, 172, 159; 57/22, 202, 350, 908; 28/272, 276

[56] References Cited

U.S. PATENT DOCUMENTS

| | | | |
|---|---|---|---|
| 2,895,285 | 7/1959 | Hilbert | 57/350 X |
| 2,985,995 | 5/1961 | Bunting, Jr. et al. | 57/908 X |
| 3,581,486 | 6/1971 | Dibble | 57/202 X |
| 3,727,274 | 4/1973 | White | 28/276 |
| 4,384,689 | 5/1983 | Bloomfield et al. | 242/18 EW X |

FOREIGN PATENT DOCUMENTS

| | | | |
|---|---|---|---|
| 903282 | 8/1962 | United Kingdom | 242/18 EW |

*Primary Examiner*—Stanley N. Gilreath
*Attorney, Agent, or Firm*—Kenyon & Kenyon

[57] ABSTRACT

After winding of a thread into a package, the thread is severed and, in order to prevent whirling of the thread end around the package, the end portion is interlaced with the package surface during the braking phase of the package. Interlacing is performed by blowing pressure jet against the thread end and the package surface within an interlacing chamber defined by a pivotally mounted shoe from which the pressure jet is emitted.

23 Claims, 2 Drawing Sheets

Figure 1:
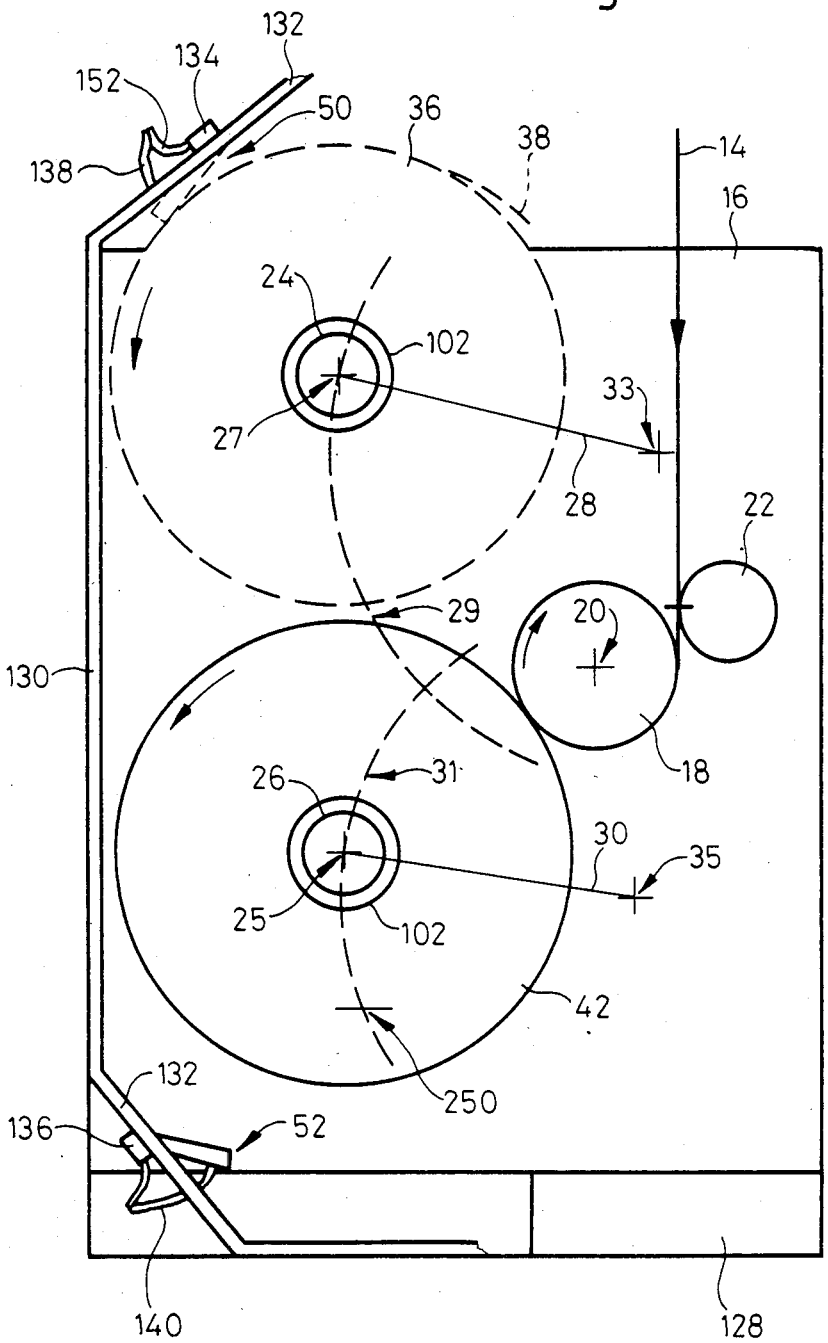

A
X
H
h
D
B
L
b
50
56
154
64
148
144
134
146
150
142
66
54
68
60
62
58
70

METHOD AND APPARATUS FOR WINDING A THREAD AND A PACKAGE FORMED THEREBY

The invention relates to a method of winding a thread to form a package, to an apparatus for carrying out the method and to the product in the form of a package.

The word "thread" is intended to cover all elongated structures of fibers and filaments. However, the invention is particularly suitable for winding of synthetic filament yarns, for example multifilament yarns of polyester, polyamide or polypropylene for textile, industrial or technical purposes.

Synthetic filament yarns are currently delivered at very high speeds to winding units for winding packages. Each winding unit comprises a package support (for example a chuck) and means for rotating the package about its axis during take-up of the thread. Delivery speeds currently range between about 2500 and 6000 m/min. depending upon thread titer.

After completion of a package, the thread is severed, a loose thread end being formed upon the package which thereafter is brought to a stop either by permitting run-down of package rotation or, preferably, by braking. The package is then removed from the support which becomes available for winding of a new package. This operation can be carried out by hand or by an automatic device. Winding of the continually delivered thread may be temporarily interrupted during the preparation of the package support; alternatively, the thread may be wound on a second package support during preparation of the first support so that a continual or waste-free winding process is possible.

Winding machines in accordance with the above description are known form the following publications:

U.S. Pat. No. 4,298,171; U.S. Pat. No. 4,497,450; U.S. Pat. No. 4,106,710; U.S. Pat. No. 4,007,884

U.S. Pat. No. 4,069,985; U.S. Pat. No. 4,106,710; EPA No. 110359; EPA No. 161385

During the period elapsing between the time at which the thread is severed and the time at which the package comes to a stop, the loose thread end is hurled around by the (declerating) rotation of the package. This has several associated disadvantages. Accordingly, various proposals have already been made to restrain the whirling of the thread end and/or to protect neighboring machine components from this thread end, for example as described in U.S. Pat. Nos. 3,165,274, 3,409,238, 4,327,872 and 4,339,089. A screening means for this purpose is also described in U.S. Pat. No. 4,598,876 and the content of this patent specification is hereby incorporated in the present description.

It is therefore possible to deal with the effects of the loose thread end within the winding machine. However, after doffing (removal of the package from the support), the thread end is still loose and is therefore liable to prejudice further handling of the package (for example transport). Accordingly, the thread end is normally "secured" to the package surface in some manner by the operating personnel, for example by knotting or by fixing in place with an adhesive or adhesive tape (see for example Japanese Patent Publication No. 46-7614 of Feb. 25, 1971.

At least one proposal has already been made for carrying out the securing of the thread end in the winding machine, namely in Japanese Patent Publication No. 48-28380 of Aug. 31, 1973. In accordance with this proposal, a glue is applied to a length of thread near the thread end so that the thread end itself is glued during winding onto the package by the portion to which glue has been applied. However, the problems of applying glue only to a certain length of thread are considerable and this method of securing the thread has not become accepted in commercial practice.

Accordingly, it is an object of the invention to be able to secure a thread end portion to a thread package in a relatively easy and rapid manner.

It is another object of the invention to secure a thread end portion to a thread package in a manner sufficient to hold the thread end in place during transport and handling.

It is another object of the invention to provide a relatively simple apparatus for securing a thread end portion to a surface of a thread package.

It is another object of the invention to be able to secure a thread end to a package in a simple economical and reliable manner.

It is another object of the invention to secure a thread end to a thread package without the application of additional materials such as glue.

Briefly, the invention provides a method and apparatus for winding a thread into a package as well as into a thread package made thereby.

In a first aspect, the invention provides a method for winding a thread into a package wherein after completion of the package the thread is severed whereby a thread end portion is formed. The method is characterized in that the thread end portion is interlaced with at least one winding on the package surface and is thereby secured to the package.

In the connection, the expression "interlacing of the thread' refers to mutual interference (interweaving, comingling) of thread portions such as individual filaments or fibers. Such an interlacing effect can be produced by directing a jet of treatment medium (for example air or water) onto the thread end and a region of the package surface with which the thread end is to be interlaced.

In a second aspect, the invention provides winding apparatus with means for winding a thread into a package and a means for securing the thread end to the package surface. The apparatus is characterized in that the securing means has a pressure jet with a mouthpiece adapted to cooperate with the package surface to form an interlacing chamber. Preferably, the securing means also comprises thread guiding means to direct the thread end into a predetemined region of the package surface. The mouthpiece of the pressure jet is then so arranged to form the interlacing chamber in this region.

In a third aspect, the invention provides a thread package which is characterized in that the thread end portion is interlaced with at least one outer winding of the package and is thereby secured.

In the following description, the expression "running-down of the package' is used for the phase during which package rotation is decelerated regardless of whether this deceleration is effected by braking or otherwise.

The thread guide means mentioned in connection with the second aspect can be in the form of an element which lies adjacent or in contact with the package surface during running-down of the package. This element is advantageously trough-shaped, having a groove which extends in the circumferential direction of the package while the open side of the groove faces the package surface. Advantageously, the groove is convergent in the direction of rotation of the package.

The pressure jet should also be arranged near the package surface preferably immediately following the thread guide means as viewed in the direction of rotation of the package. Preferably, the mouthpiece of the pressure jet is in contact with the package surface during the interlacing step. The mouthpiece can comprise a channel which also extends in the circumferential direction of the package and represents an extension of the groove of the trough-shaped guide element. In operation, a treatment medium (for example air or water) is supplied to this channel so that the walls on both sides of the channel form the interlacing chamber together with the package surface.

In the preferred embodiment, the thread guiding means and the pressure jet are integrated into a single body. This body can be supported by a holder which permits movement of the body between a withdrawn position and an operating position. In the latter, the portion of the body having the pressure jet can be resiliently pressed againt the package surface, for example when the package is moved from a winding position into a rest position (braking position).

Figures 2, 3, 4:
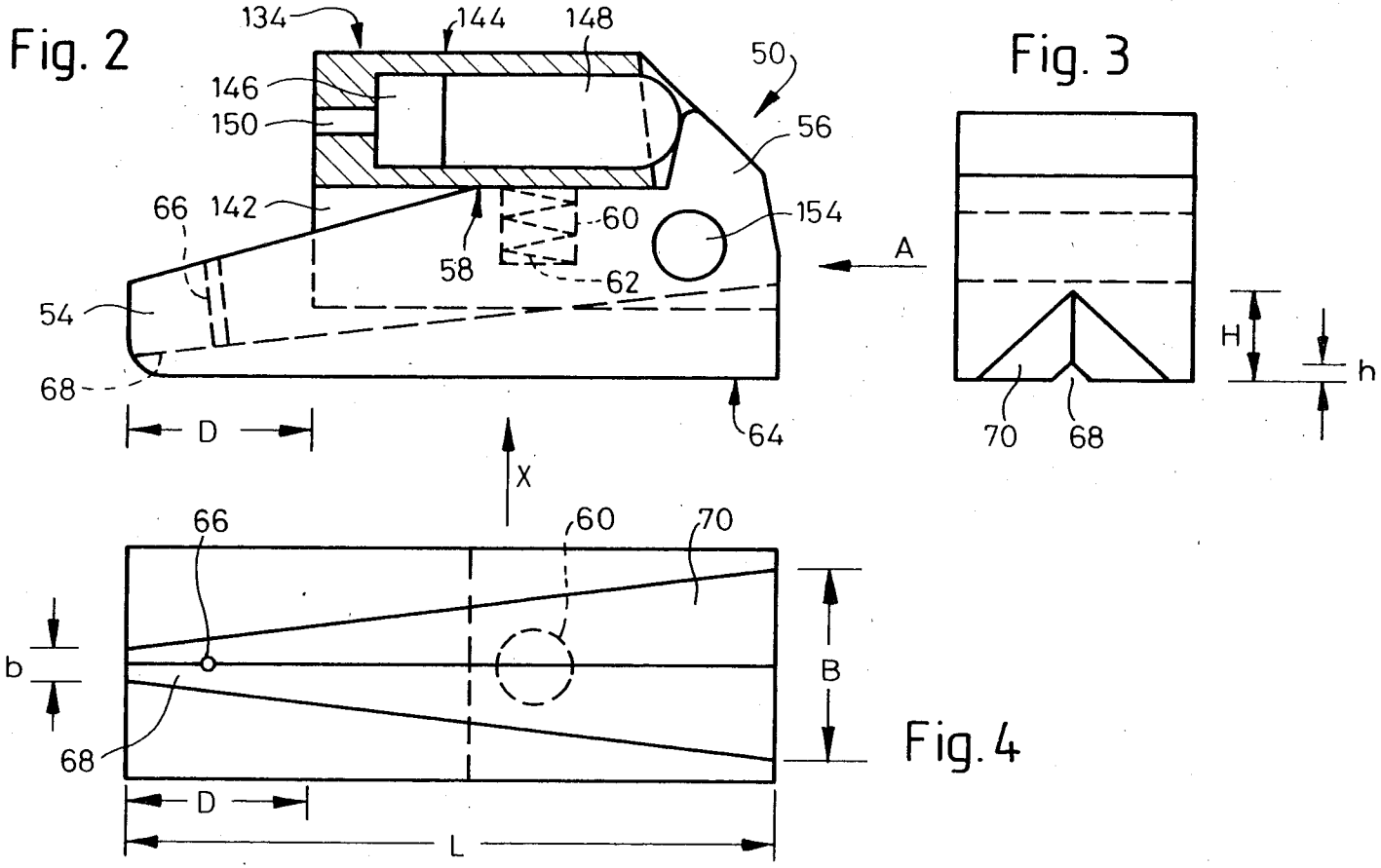

As an example, one embodiment of the invention will now be explained in further detail by reference to the drawings, in which:

FIG. 1 is a front view of a winding machine fitted with a device in accordance with the present invention, FIG. 2 is a detail taken from the arrangement of FIG. 1, FIG. 3 is a view taken in the direction of the arrow A in FIG. 2, and FIG. 4 is a view in the direction of the arrow X in FIG. 2.

The winding machine in FIG. 1 is substantially the same as that shown in FIG. 15 of U.S. Pat. No. 4,497,450. The arrangement, and the mode of operation, of this machine have been described in the U.S. Patent and will not be repeated here; the illustrated components will be simply identified.

A thread (multifilament yarn) 14 is delivered from a non-illustrated spinning system to the illustrated machine for winding up. A machine housing 16 contains support and drive components (not shown) and a cantilever-supported friction roll 18 projects from the front face of the housing 16. This friction roll 18 can be set in rotation about its longitudinal axis 20, at a controllable speec, by a non-illustrated motor in housing 16.

An upper chuck 24 also projects from the front face of housing 16 and is supported at its end within the housing 16 by a swing arm. The swing arm itself is not shown in FIG. 1 but is indicated by its longitudinal axis 28. The swing arm is pivotable within the housing about a pivot point 33 in order to move the chuck 24 downwardly from an upper rest position (illustrated in FIG. 1). Chuck 24 is cantilever-mounted on the swing arm so as to permit rotation of the chuck about its longitudinal axis 27. During the pivotal movement of the carrier arm, the longitudinal axis 27 follows a path which is indicated by the dotted line 29.

In operation, chuck 24 carries a bobbin tube 102 which serves as a former for a package 36. After the full package 36, together with the tube 102, has been revmoed from the chuck 24 manually or automatically, an empty tube can be donned on the chuck so that the latter is ready for a new winding cycle. At the start of such a cycle, the swing arm pivots downwardly until tube 102 comes into contact with the friction roll 18, the chuck 24 being driven about its own longitudinal axis 27 through the contact with the friction roll 18. The thread 14 is now wound about the tube 102 while being traversed back and forth along the chuck axis 27 by a conventional traverse mechanism 22 in order to form cross windings in the new package.

During winding of the thread, the carrier arm swings upwardly again to enable build up of the new package between tube 102 and friction roll 18. In the course of this operation. The new package is continually maintained in contact with the friction roll 18 with a controllable contact pressure. When this package has reached a predetermined dimension, the carrier arm is rapidly pivoted upwardly in order to interrupt contact between the package and the friction roller and thus to interrupt transfer of drive forces from the friction roller to the package.

Thread 14 is delivered continually and is preferably wound up continually in order to avoid waste of valuable material. For this purpose, a second, lower chuck 26 is provided which can take over the thread 14 upon interruption of winding on the upper chuck 24 and continue winding of the thread. Chuck 26 is carried by a lower swing arm (indicated by its longitudinal axis 30) and is also cantilever-mounted in order to enable rotation of the chuck about its longitudinal axis 25. The lower carrier arm is pivotable about a pivot axis 35 to effect movement of the chuck 26 along the path of the longitudinal axis 25 indicated by the dotted line 31. In operation, chuck 26 also carries a tube 102 and the thread 14 is built up to a package 42 around this tube.

During formation of a lower package 42, chuck 24 is returned to its rest position and brought to a standstill after which the completed upper package 36 can be removed from the chuck and replaced by an empty tube 102. FIG. 1 is unrealistic insofar as it shows a full package both on the upper chuck 24 and on the lower chuck 26. At this stage of formation of the lower package 42, the upper chuck 24 should actually carry an empty tube 102 and be ready to swing back into the winding position to take up the thread 14 from the full package 42 so that chuck 25 can be pivoted back along the path 31 into its rest position with longitudinal axis 25 in the position 250. However, this invention is concerned with the problems of running-down of the full package and not those of transfer of the thread to the empty tube. The Fig. therefore shows two full packages, the upper package 36 being represented by dotted lines.

Adjacent the end face of the housing 16 there is an 'operating zone' which contains the moving package supports (chucks 24, 26) and the thread guiding component 18, 22. A base plate 128 is located underneath the right-hand side portion of this operating zone. A seperating wall 130 is provided on the left-hand side of the operating zone, being supported by the housing 16 and extending forwardly therefrom. The seperating wall 130 carries at its upper and lower ends respective extensions 132, each of which is only partially illustrated and which form part of a hood (not shown) for the operating zone.

The upper extension 132 carries a holder 134 for a first means 50 for securing a thread end while the lower extension 132 carries a holder 136 for a second means or device 52. The devices 50, 52 are rotatably supported by their respective holders so that each device can be pivoted between a withdrawn position and a readiness position (illustrated in FIG. 1 for the device 52). The readiness position of device 52 is so arranged relative to the path 31 that the surface of the full package 42 comes into contact with the end portion of the device 52 during pivoting of the chuck 26 back into its rest position 250.

When the package 42 has arrived in its rest position, it has forced the device 52 back towards its withdrawn position, but not completely back into that position. The upper device 50 and the full package 36 cooperate in a similar manner, this "operating position' for the device 50 being indicated in FIG. 1 with dotted lines. The angle of pivot of the device 50 or 52 between its readiness position and its operating position is dependent upon the diameter of the respective full package 36 or 42; the readiness position of the device 50 or 52 must be so disposed that the device comes into contact with the surface of a full package 36 or 42 respectively during the "return movement' of this package (even when the package diameter has the minimum designed value).

After the rotation of the full package 36, or 42 has been brought to a stop by a brake device (not shown), the device 50, or 52, is pivoted back from the operating position into the withdrawn position. This last-named position is so arranged for each device that the device leaves the respective full package 36, or 42, free for doffing (removal from the chuck 24, or 26). When doffing has been carried out, the device 50, or 52, can be pivoted back into the readiness position. As subsequently explained in further detail with reference to the additional Figures, each device 50, 52 comprises a pressure jet. In order to enable this jet to be supplied with pressure air from a non-illustrated source in the housing 16, each device is connected with that source by means of a respective, flexible pneumatic lead 138, 140.

The structure of each device 50, 52, together with its respective holder 134, 136, and the mode of operation of these devices will now be explained in further detail with reference to FIGS. 2 to 4. Since the lower device 52 is similarly constructed and operates in the same manner as the upper device 50, only the latter and its holder 134 will be illustrated and described in the remainder of the specification. Everything which is said in connection with this upper device applies equally to the lower device 52.

In the following description of the mode of operation of the upper device 50, it is assumed that the upper chuck 24 has just been swung back into its rest position but has not yet been braked to a standstill. Accordingly, the full package 36 is still rotating with high speed around the chuck axis 27. Due to the centrifugal force, the newly-formed loose thread end 38 is therefore hurled radially outwardly from the package surface despite air resistance. For reasons related to the transfer of thread 14 from the upper chuck 24 to the lower chuck 26 (which reasons are described in U.S. Pat. No. 4,497,450, in particular in connection with FIG. 14 thereof), the thread 14 is removed from the traverse device 22 during transfer and is brought into a predetermined position in the axial direction on the package 36. The last windings of the full package 36 therefore form an end section in the form of a low ridge of parallel windings on the package surface and the thread end 38 projects further radially outwardly from this ridge due to the centrifugal force. The device 50 is so arranged in the axial direction relative to the chuck 24 that in its operating position (FIG. 1) it forms a bridge over this ridge.

FIG. 2 shows the holder 134 and the device 50 with the latter in its withdrawn position. Holder 134 is in the form of a yoke with two side walls (only one, 142, being visible in FIG. 2) and an intermediate portion 144. The two side walls 142 sit on the hood portion 132 (FIG. 1, not shown in FIG. 2), and the intermediate portion 144 extends over an opening (not shown) in hood portion 132 between the two side walls 142.

The intermediate portion 144 has a chamber 146 with a piston 148 therein. The chamber 146 is open at one end and piston 148 can project from this open end. Intermediate portion 144 also has a bore 150 which opens at one end into the chamber 146 and is connected at its other end with a pressure air lead 152 (FIG. 1, not shown in FIG. 2). When chamber 146 is supplied with pressure air from lead 152, piston 148 is forced towards the open end of chamber 146.

Device 50 is integrated into a single body in the form of a pivotable shoe 54. Shoe 54 is pivotably mounted on a pin 154 extending between the side walls 142 of the holder 134. The shoe can rotate about the longitudinal axis of pin 154 through the non-illustrated opening in hood portion 132 (FIG. 1) between the readiness position and the withdrawn position.

At one end, shoe 54 is provided with a nose 56 which, when piston 148 is forced outwardly, is pivoted clockwise by piston 148 around the axis of pin 154. However, this pivotal movement is limited by contact between an abutment surface 58 on the shoe and the underside of the intermediate portion 144, the withdrawn position of the device 50 being thereby defined (as illustrated in FIG. 2).

The shoe 54 also has a blind bore 60 which opens onto the surface 58 (see also FIG. 4). Blind bore 60 contains a compression spring 62 which cooperates with the underside of the intermediate portion 144 and the inner end of the bore 60 to generate a return force opposing the pivotal effect of the piston 148. As soon as chamber 146 is vented, shoe 54 therefore rotates in the counterclockwise direction around the longitudinal axis of pin 154 to return piston 148 into the chamber 146. This return movement continues until the nose 56 engages the intermediate portion 144, the readiness position of the device 50 being thereby defined.

As already previously described, the operating position of device 50 lies somewhere between the illustrated withdrawn position and the readiness position, and is dependent upon the package diameter. In any event, in the operating position the shoe 54 is resiliently pressed against the package surface by the return force exerted by spring 62. In this way, an end portion of the surface 64, which faces towards the package surface, is brought into contact with the package surface at the end of the shoe remote from the nose 56. Contact can be made within a region D of the surface 64. This region D therefore defines a "contact portion' of the shoe 54 which in operation can be brought into contact with the full package.

As apparent from FIG. 1, surface 64 extends tangentially to the package surface in the operating position. The contact portion of shoe 54 is then at the rear end of the shoe considered in the direction of rotation of the full package 36. The leading portion of the shoe 54 (in front of the contact portion viewed in the direction of rotation of package 36) forms a thread guide means which will later be described in detail. The contact portion itself forms a pressure jet with a specially formed mouthpiece as will be described in the following.

The pressure jet formed by the contact portion comprises a bore 66, which extends approximately radially to the full package 36 in the operating position, and a channel 68 in the surface 64, this channel extending in the longitudinal direction of the shoe 54. When surface 64 engages the package surface on both sides of the channel 68, the latter forms together with the package surface an interlacing chamber which can be supplied with pressure air from the lead 138 (FIG. 1) via the bore 66.

If now the loose thread end 38 (FIG. 1) is approximately aligned with the channel 68, and is drawn along the channel during each revolution of the package 36, the interlacing chamber being simultaneously supplied with pressure air of adequate pressure, then the thread end 38 is disturbed so that the filaments of the thread end 38 are interlaced (interwoven, commingled) with the outer windings of the ridge, i.e. the individual filaments of the multifilament yarn mutually intefere after the interlacing step so that the thread end is secured to the package surface. The degree of interlacing is dependent upon many factors, in particular upon the air pressure. The degree of interlacing should be so selected that the thread end remains secured to the package surface during the transport and storage of the package but can be released again from the package surface by operating personel by rubbing during further processing of the package.

The above-mentioned thread guide means (in front of the pressure jet as viewed in the direction of rotation of package 36) is not brought into contact with the package surface. This guide portion is given a trough-shape by a groove 70 which opens onto the surface 64. Groove 70 also extends in the longitudinal direction of shoe 54 and is aligned with the channel 68. Groove 70 is convergent in its longitudinal direction from its leading end towards the channel 68. In the example of FIGS. 3 and 4, the channel 68 is also convergent from the groove 70 back to the trailing end of the shoe 54; this facilitates manufacture of the shoe 54 (with a continual convergence of the groove 70 and channel 68 from the leading to the trailing end of the shoe). However, this is not essential.

Further, in the example of FIGS. 3 and 4, both groove 70 and channel 68 have V-cross sections, the apex of the V lying in an imaginary plane which divides the shoe 54 into two equal elongate parts. However, a cross section of this form is also not essential for thread securement. The convergence is provided both in the width (B to b) and in the height (H to h).

It will probably already be clear that the groove 70 operates as a guide trumpet for the loose thread end 38 (FIG. 1). As the package 36 rotates beneath the shoe 54, the thread end 38 is brought into the leading end of groove 70 during each revolution and is aligned in the longitudinal direction with the channel 68 by means of the convergence of the groove, thereby enabling the desired interlacing to occur.

The following dimensions are given simply as examples for a shoe 54 in accordance with the embodiment of FIGS. 3 and 4:

Length L of the shoe from the leading to the trailing end—110 mm

Length D of the contact portion—15 to 20 mm

Diameter of the bore 66—0,5 to 1,5 mm

Width of the shoe 54 (in the axial direction of chuck 24)—40 mm

Maximum width B of the groove 70 at the surface 64 (at the leading end of the groove)—30 to 35 mm Minimum width b of the channel 68 at the surface 64 (at the trailing end of the channel)—5 to 8 mm Angle between the sides of the groove 70 and channel 68 at the center line of the shoe 54—45°

Maximum height H of the groove 70—16 mm

Minimum height h of the channel 68—3 mm

Further variations

The apparatus is of course not limited to the illustrated and previously described variants. The pressure jet can for example comprise more than one supply bore for the pressure air. The bore 66 in FIG. 4 can be arranged at an inclination to the radius of the package 36 in the longitudinal and/or transverse direction relative to the shoe 54. Correspondingly, where there is a plurality of supply bores, one or more such supply bores can be arranged at an inclination to the radius.

The pneumatic pressure can lie between 2 and 6 bar in the example of FIGS. 3 and 4. The required air pressure must be established from case to case in dependence upon the operating circumstances. Where the operating pressure is too low, an adequate degree of interlacing is not achieved. Increase in pressure above the value at which an adequate degree of interlacing is achieved represents unnecessary expenditure of energy and can also bring functional disadvantages if the thread end is thereby interlaced too strongly with the package surface.

An interlacing medium other than air could also be used, water serving as an obvious example in this respect. However, air is the prefered medium since other gas streams cause complications and a liquid is associated with a greater or lesser risk of fouling.

It would also be possible to operate with a water mist in the pressure air. This would have the effect of activating the spinfinish on the filament yarn and providing additional, temporary "adhesive effect'.

Whether or not it is necessary to provide a thread guidance portion depends upon the behaviour of the thread end, which in turn is dependent upon the operating circumstances. If the thread end runs easily into the interlacing chamber without additional guidance, then the pressure jet (with its specially formed mouthpiece) is alone sufficient. However, normally thread guiding means will prove essential to success. The guide means must be provided in front of the pressure jet considered in the direction of rotation of the package, but does not have to be formed in one piece with the pressure jet.

In the contact portion, the "contact surface' 64 should be able to sit evenly on the package surface and form the best possible "seal' with the package, but without damaging the package surface. Contact between the mouth piece of the pressure jet and the package is not essential to formation of an interlacing chamber. If, however, a space is left between the mouthpiece and the passage during the interlacing step, then a higher air pressure must be used to achieve a given degree of interlacing. Furthermore, a more exact guidance of the thread end must be ensured, because otherwise the thread end can escape from the interlacing medium by slipping between the pressure jet and the package surface. In any event, it is most unlikely that a usable interlacing effect will be achieved if the spacing between the mouth-piece of the pressure jet and the package surface is more than 5 mm in the operating position.

U.S. Pat. No. 4,598,876, describes a screening means for a winding machine of the type illustrated in FIG. 1 in order to separate the lower package from an upper package located in its rest position. Such a screening means may prove to be superfluous if the winding machine is formed as described above; however, such a screening means may also be used.

The embodiment described by way of example is arranged for a winding machine with an automatic changeover, that is the thread 14 (FIG. 1) is transferred without intervention of operating personnel from one chuck to another in accordance with a predetermined, automatic changeover sequence. Thereafter, doffing (removal of the full package) can be carried out by hand or by an automatic device. The apparatus is, however, equally advantageous in association with a non-automatic winder where winding is temporarily interrupted after completion of a full package while the chuck is prepared for the next winding cycle. Equally, the apparatus and method are advantageous in association with other types of automatic winding machines, for example in accordance with the U.S. Pat. No. 4,298,171.

In the illustrated example, the machine winds a single thread 14 to a package. However, it is currently normal practice to wind a plurality of threads simultaneously upon a single chuck to form a corresponding plurality of packages. In this case, a respective thread end securing device must be provided for each intended package.

As viewed in a direction transverse to the package axis, the loose thread end should be aligned approximately parallel to the windings with which it is to be interlaced. Preferably, these windings are themselves "parallel windings' and not "cross windings". Since the package is actually built up of cross windings, several parallel windings should be formed at the end of package formation for interlacing with the thread end.

Formation of such parallel windings occurs automatically if the thread is lifted out of the traverse mechanism while still being wound onto the package. This is carried out for other reasons as part of the changeover operation in many automatic winders (ridge formation).

The invention has been described in connection with a machine having friction drive between the friction roll and the package. However, it can be used also in a machine having direct drive to the chucks.

The invention thus provides a relatively simple technique for securing a thread end to a thread package at the completion of winding. Further, the degree of securement is such as to be sufficient to hold the thread end in place during doffing and transport while at the same time permitting manual release of the thread end by operating personnel.

The technology of interlacing has become well-established in the field of processing filament yarns. Early examples of this technology are to be found in U.S. Pat. Nos. 3,443,292 and 3,727,274. Systematic treatments of the topic can be found in the articles "Verwirbelung von Filamentgarnen im Luftstrom" by Prof. Lünenschloss and J.-P. Zilg (Chemiefasern/Textilindustrie of October 1980, Pages 809 ff) and "Mechanismus der Verwirbelung von Filamentgarnen" by Dr. H. Weinsdörfer (Chemiefasern/Textilindustrie of March 1981, Pages 198 ff).

What is claimed is:

1. A method for winding a multifilament thread into a package comprising the steps of winding a continuous multifilament thread into a package with the last winding forming an end section of parallel windings on an outer surface of the package;

severing the thread to form a thread end portion; and interlacing the thread end portion with at least one winding of said end section by disturbing the filaments of the thread end portion to releasably secure the thread end portion with said end section.

2. A method as set forth in claim 1 wherein said interlacing step includes feeding an interlacing medium against the thread end portion to interlace the thread end portion with the package surface.

3. A method as set forth in claim 1 which further comprises the step of aligning the thread end portion in a predetermined disposition on the package surface prior to said interlacing step.

4. A method for winding a thread into a package comprising the steps of winding a continuous multifilament thread into a rotating package;

severing the thread to form a thread end portion while continuing to rotate the package; and directing a jet of fluid medium against the thread end portion and a surface of a thread package to interlace the thread end portion with said surface.

5. A method as set forth in claim 4 wherein the jet of fluid medium is at a pressure sufficient to secure the thread end portion to said package surface and remain secured to said surface during transport and storage of the package.

6. A method as set forth in claim 4 wherein the jet of fluid medium is an air jet.

7. A method as set forth in claim 6 wherein the air pressure is between 2 and 6 bar.

8. A method as set forth in claim 4 wherein the jet of fluid medium is a water jet.

9. A method as set forth in claim 4 which further comprises the steps of winding a plurality of windings onto the thread package to form a ridge prior to severing the thread and interlacing the thread end portion with the windings of the ridge.

10. An apparatus for winding a thread package comprising means for winding a thread to form a package; and means for securing an end of the thread to a surface of the package, said means including a pressure jet with a mouthpiece for cooperating with said package surface to form an interlacing chamber for interlacing of the thread end with said surface.

11. An apparatus as set forth in claim 10 wherein said securing means includes a thread guide means for aligning the thread end in a predetermined region of the package surface, said mouthiece being disposed in said region to form said chamber thereat.

12. An apparatus as set forth in claim 11 wherein said pressure jet and said thread guide means are disposed in a common body.

13. An apparatus as set forth in claim 11 wherein said mouthpiece includes a channel for guiding the thread end and said thread guide includes a groove for guiding the thread end and aligned with said channel.

14. An apparatus as set forth in claim 11 wherein said thread guide converges in the direction of rotation of the package.

15. An apparatus as set forth in claim 10 wherein said securing means includes a holder having said mouthpiece resiliently mounted thereon for pressing against the package surface.

16. In an apparatus for winding a multifilament thread into a thread package first means for winding a multifilament thread into a rotation thread package; and second means for directing a jet of fluid medium against a thread end portion of the thread and a surface of the thread package to interlace the thread end portion with the package surface.

17. An apparatus as set forth in claim 16 wherein said second means includes a shoe having a surface for contacting the surface of a thread package, a channel in said shoe surface to define an interlacing chamber with the thread package for the thread end portion and a bore extending into said channel to direct the jet of fluid into said channel.

18. An apparatus as set forth in claim 17 wherein said bore is disposed transversely of said shoe surface.

19. An apparatus as set forth in claim 17 wherein said second means includes a holder having said shoe pivotally and resiliently mounted therein.

20. An apparatus as set forth in claim 16 wherein said second means includes a shoe having a channel to define an interlacing chamber opposite the thread package surface and a bore extending into said channel to direct the jet of fluid into said channel for interlacing of the thread end portion within said chamber.

21. A package of synthetic multifilament yarn comprising a cross-wound body of yarn and an end section of parallel windings on an outer surface of said body, a trailing end of the yarn having disturbed filaments interlaced with said end section to secure said yarn end thereto.

22. A device for mounting on a winding machine to secure a thread end to a thread package, said device comprising a holder for securement to a winding machine; and a shoe pivotally mounted in said holder and having a surface for contacting the surface of a thread package, a channel in said surface to define an interlacing chamber with the thread package for a thread end portion and a bore communicating with said channel to direct a jet of fluid into said channel to interlace a thread end portion therein to the thread package.

23. A device as set forth in claim 22 wherein said holder includes a piston movable mounted therein for selectively pivoting said shoe therein and which further comprises a spring between said holder and said shoe for biasing said shoe against said piston.

* * * * *